United States Patent [19]

Girard et al.

[11] Patent Number: 4,522,396

[45] Date of Patent: Jun. 11, 1985

[54] GAME BALL

[75] Inventors: Thomas L. Girard, Pratt, Kans.; Monty D. Lewis, Greeley, Colo.

[73] Assignee: Indoor Activities Unlimited, Pratt, Kans.

[21] Appl. No.: 539,530

[22] Filed: Oct. 6, 1983

[51] Int. Cl.[3] ..... A63B 37/12

[52] U.S. Cl. ..... 273/58 K; 273/DIG. 20; 273/60 B; 273/DIG. 8

[58] Field of Search ..... 273/58 K, DIG. 20, DIG. 8, 273/60 B, 26 R, 29 A, 58 R, 58 A, 58 B, 58 BA, 58 J, 65 EE, 428

[56] References Cited

U.S. PATENT DOCUMENTS 4,003,573 1/1977 Craig et al. ..... 273/58 K
4,131,276 12/1978 Judkins ..... 273/58 K

FOREIGN PATENT DOCUMENTS 1405454 9/1975 United Kingdom ..... 273/58 K

*Primary Examiner*—George J. Marlo
*Attorney, Agent, or Firm*—Laney, Dougherty, Hessin, Claro & Beavers

[57] ABSTRACT

A ball for use in an indoor or outdoor baseball-type game played by a small number of players in a playing field of limited size. The ball is pitched by a defensive player to an offensive player who tries to strike the ball with an elongated bat. The ball weighs less than 2 ounces and is made of a resilient, low mass material of generally spherical configuration with an outside diameter of at least 2 inches, and having a plurality of interconnecting concave indentations thereon. The width of each of the indentations is at least ⅛ inch. The bat contains a longitudinal bore in the ball striking end thereof, and the dimensions of the bore and the ball are such that when the end of the bat is pressed against the ball, the ball is forced into the bore and retained therein until removed by a player.

3 Claims, 3 Drawing Figures

GAME BALL

BACKGROUND OF THE INVENTION

I. Field of the Invention

This invention relates to balls used in games, and more particularly, to a ball used in a baseball-type game played either indoors or outdoors.

II. Brief Description of the Prior Art

The typical baseball or softball is spherical and has a substantially smooth surface except for the familiar stitching thereon. Other baseball-type games use basically the same ball or scaled version thereof with little or no variation. Some games such as those shown in U.S. Pat. Nos. 819,212 to Filer, 2,488,919 to Mansfield and 2,862,712 to Delia et al attach a cable to the ball. None of these previous games disclose a ball such as that of the present invention which is made from a resilient, low mass material having an irregularly shaped outer surface.

BRIEF DESCRIPTION OF THE PRESENT INVENTION

The game in which the ball of the present invention is to be used is designed such that players or officials can predesignate scoring areas in the playing field. The game is suitable for either indoor or outdoor play.

In the preferred embodiment of the game, teams are comprised of at least one player although the game can be played with more players per team depending on the area available and the desire of the players. Specific areas in the field of play are predesignated by the teams to indicate possible scoring and theoretical offensive player movement of a baseball game. For example, if the game is played inside, various items of furniture or wall hangings can be designated to be singles, doubles, triples, homeruns, foul balls, outs, or the like. Further, boundary marking means such as adhesive tape can be used to indicate scoring areas on the floor, walls or other objects.

In playing the game, a player of a defensive team acts as a pitcher and pitches the ball of the present invention to a player on an offensive team. The offensive player attempts to strike the ball with a bat in a manner similar to any baseball-type game. If the ball is batted to any designated scoring area and strikes the floor or comes to rest anywhere in the playing field without being caught by a defensive player, a corresponding score or player movement is awarded to the offensive team. If the ball is caught by a defensive player before striking the floor or before coming to rest anywhere in the playing field, even if after striking an object or zone constituting a designated scoring area, the offensive player is out. Typically, the game would be played with three outs per inning with the number of innings being preselected by the players or officials.

The ball of the present invention is made of a resilient, low mass material and is generally spherical in configuration, but having an irregularly shaped outer surface formed by a plurality of concave indentations therein.

The bat used in the game has a means of picking up the ball from the floor or other object. A free end of the bat defines a central opening therein such that when the free end is pushed against the ball, the ball will slide into, and be retained by, the central opening.

An important object of the present invention is to provide a ball suitable for use in playing a game by a small number of players in a playing field of limited size.

Another object of the invention is to provide a ball which is well suited to be used either indoors or outdoors.

A further object is to provide a ball made of a resilient, low mass material having an irregularly shaped outer surface formed by a plurality of interconnecting concave indentations.

Additional objects and advantages of the invention will become apparent as the following detailed description of a preferred embodiment is read in conjunction with the accompanying drawings which illustrate such preferred embodiment.

DETAILED DESCRIPTION OF THE PREFERRED EMBODIMENT

Figure 1:
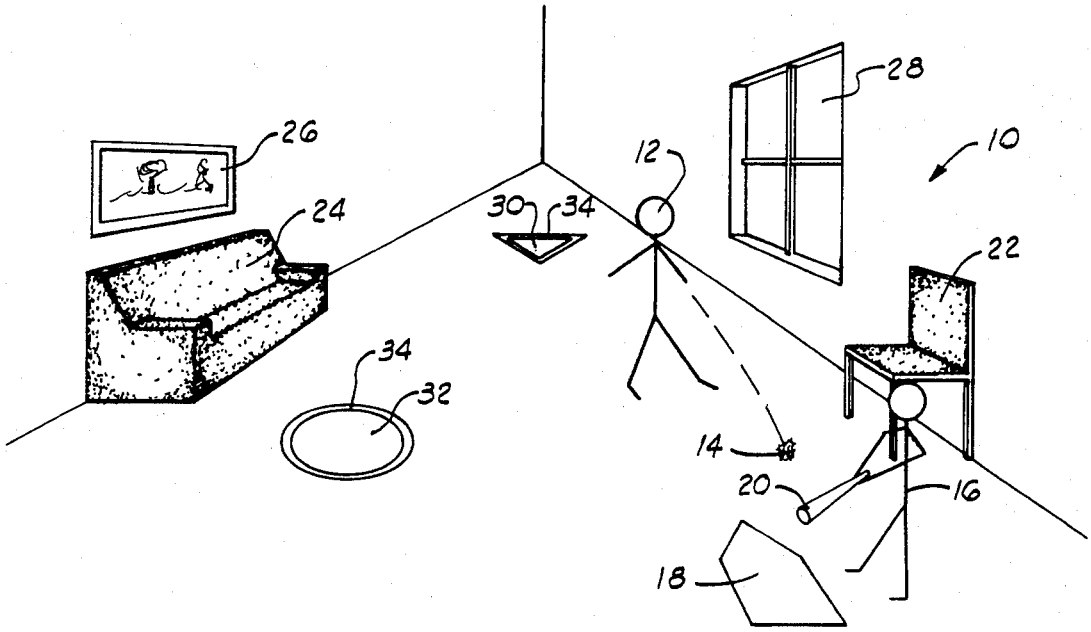
FIG. 1 shows players of the game in a typical indoor playing field.

Referring now to the drawings, and specifically to FIG. 1, a typical indoor playing field of the game in which the ball of the present invention is designed to be used is shown. Because one of the basic elements of the game is the preselection of scoring areas by players or officials depending on the arrangement of the room or outdoor area in which the game is to be played, FIG. 1 is illustrative only, and the game is not limited to the indoor arrangement shown therein.

For the example shown in FIG. 1 the entire room 10 becomes the playing field. A defensive player 12 pitches the ball of the present invention, designated by the numeral 14, to an offensive player 16 who stands adjacent a homeplate marker 18. The offensive player 16 swings at pitched ball 14 with a bat 20 in a manner typical of any baseball-type game. Scoring is then determined by an area to which the ball is batted or an object which the ball strikes after being batted. The game requires no base running. FIG. 1 illustrates the game with only one player per team, but additional players can be added if desired as space permits.

Players of officials preselect the scoring by identifying various objects in the room such as chair 22, couch 24, picture 26 and window 28 as having scoring values which indicate the play action, theoretical offensive player movement and scoring of a typical baseball game. For example, but not by way of limitation, couch 24 could be a single, window 28 could be a double and picture 26 could be designated as a homerun. Further typical scoring areas are indicated by triangle 30 and circle 32 which can be marked on the floor or walls by means of tape 34 having an adhesive surface. If the ball is batted to any of the preselected scoring areas by offensive player 16 and strikes the floor or comes to rest anywhere in the playing area without having been first caught by defensive player 12, the corresponding score is awarded to the offensive team. If the ball is first caught by defensive player 12 before striking the floor or before coming to rest anywhere in the playing field, even if after striking an object or zone constituting a designated scoring area, offensive player 16 is out. The game will normally have the typical three outs per inning of any baseball-type game, while the number of innings is preselected by the players or officials.

Figure 2:
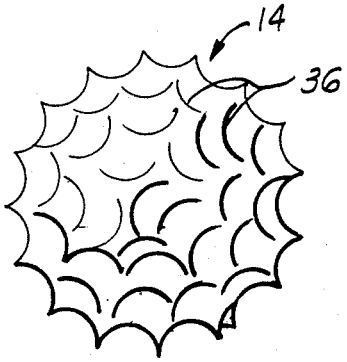
FIG. 2 illustrates the ball of the present invention.

In FIG. 2 the ball 14 of the present invention is shown as having a generally spherical configuration. A plurality of interconnecting concave indentations 36 form an irregularly shaped outer surface of the ball.

Ball 14 has an outside diameter of at least 2 inches, and indentations 36 are at least $\frac{1}{8}$ inch in width.

Ball 14 is made of a resilient, low mass material such as foam plastic or the like, and thus will not damage anything which it strikes in the room. The ball weighs less than 2 ounces and will sustain elastic deformation of at least $\frac{1}{2}$ inch per inch.

Figure 3:
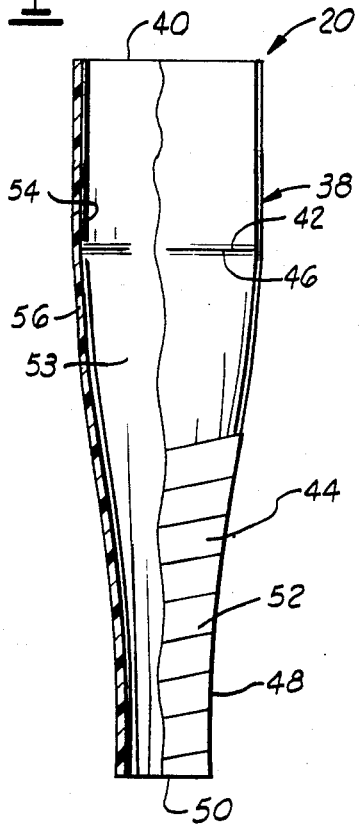
FIG. 3 presents an elevation and partial cross-section of the bat used in the game.

As shown in FIG. 3, bat 20 has a substantially cylindrical striking portion 38 having a free end 40 and terminating at an opposite second end 42. A handle portion 44 has a first end 46 integrally formed with second end 42 of striking portion 38. Handle portion 44 gradually reduces in cross-sectional area from striking portion 38 to an intermediate point 48 which forms the minimum cross-sectional diameter of bat 20. Handle portion 44 then increases in cross-sectional area from intermediate point 48 to a base end 50. Tape 52 can be wrapped around handle portion 44 to provide offensive player 16 with a better grip on bat 20.

Bat 20 further defines a central opening 53 therethrough such that free end 40 and base end 50 are open and in communication with one another. Central opening 53 has a bore 54 corresponding to striking portion 38. Wall 56 is of substantially uniform thickness. Bore 54 and resilient ball 14 are dimensioned such that when free end 40 is pressed against ball 14 the ball will be forced into, and be retained by, bore 54 until removed by a player, thus providing pickup means for picking up the ball from the floor or other object.

Bat 20 is preferably made of a light weight, resilient plastic which will not damage any furniture which it might inadvertently strike.

It can be seen, therefore, that the present invention is well adapted to carry out the objects and attain the ends and advantages mentioned, as well as those inherent therein. While a preferred embodiment has been described for the purposes of this disclosure, numerous changes can be made by those skilled in the art. All such changes are encompassed within the scope and spirit of this invention as defined by the appended claims.

What is claimed is:

1. A ball for a game in which a player attempts to strike said ball with a hitting device, said ball comprising:

a low mass material weighing less than 2 ounces;

a substantially spherical configuration with an outside diameter of at least 2 inches; and an outer surface defining a plurality of interconnecting concave indentations therein, each of said indentations having a width on said surface of at least $\frac{1}{8}$ inch.

2. Ball of claim 1 wherein said low mass material is further characterized as being resilient.

3. Ball of claim 1 wherein said material is a foam plastic.

* * * * *